US006886850B2

(12) United States Patent
Taylor et al.

(10) Patent No.: US 6,886,850 B2
(45) Date of Patent: May 3, 2005

(54) SNOWBOARD BOOT BINDING

(75) Inventors: G. Scott Taylor, Stowe, VT (US); Franklin S. Phillips, Richmond, VT (US); Robert L. Spraque, Stowe, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 10/007,128

(22) Filed: Dec. 3, 2001

(65) Prior Publication Data

US 2003/0102652 A1 Jun. 5, 2003

(51) Int. Cl.[7] ..... A63C 9/00

(52) U.S. Cl. ..... 280/636; 280/14.22; 280/623; 280/11.3

(58) Field of Search ..... 280/14.21, 14.22, 280/14.24, 611, 613, 616, 617, 618, 619, 620, 623, 11.36, 633, 636; 36/117–121

(56) References Cited

U.S. PATENT DOCUMENTS

| | | | | | |
|---|---|---|---|---|---|
| 2,950,118 | A | | 8/1960 | Sharpe | |
| 3,398,969 | A | * | 8/1968 | Perry | 280/611 |
| 3,854,743 | A | | 12/1974 | Hansen | |
| 4,461,098 | A | * | 7/1984 | Diegelman | 36/2 R |
| 4,622,764 | A | * | 11/1986 | Boulier | 36/68 |
| 4,772,041 | A | | 9/1988 | Klosterman | |
| 4,871,186 | A | * | 10/1989 | Klosterman | 280/611 |
| 4,878,301 | A | * | 11/1989 | Kiyosawa | 36/69 |
| 4,979,760 | A | | 12/1990 | Derrah | |
| 4,998,358 | A | * | 3/1991 | Girardelli | 36/117.3 |
| 5,056,509 | A | * | 10/1991 | Swearington | 602/29 |
| 5,189,814 | A | * | 3/1993 | Barma | 36/4 |
| 5,317,820 | A | * | 6/1994 | Bell et al. | 36/89 |
| 5,435,080 | A | | 7/1995 | Meiselman | |
| 5,499,461 | A | * | 3/1996 | Danezin et al. | 36/117.2 |
| 5,505,477 | A | | 4/1996 | Turner et al. | |
| 5,577,755 | A | | 11/1996 | Metzger et al. | |
| 5,636,455 | A | | 6/1997 | Meiselman | |
| 5,647,148 | A | | 7/1997 | Meiselman | |
| 5,655,786 | A | * | 8/1997 | Raftogianis | 280/14.24 |
| 5,660,410 | A | | 8/1997 | Alden | |
| 5,690,350 | A | | 11/1997 | Turner et al. | |
| 5,690,351 | A | * | 11/1997 | Karol | 280/618 |
| 5,755,046 | A | | 5/1998 | Dodge | |
| 5,758,895 | A | | 6/1998 | Bumgarner | |
| 5,802,741 | A | | 9/1998 | Turner et al. | |
| 5,906,058 | A | | 5/1999 | Rench et al. | |
| 5,915,720 | A | | 6/1999 | Turner et al. | |
| 5,937,546 | A | * | 8/1999 | Messmer | 36/89 |
| 5,941,554 | A | * | 8/1999 | Bourdeau | 280/617 |
| 5,947,508 | A | | 9/1999 | Graf et al. | |
| 5,966,843 | A | | 10/1999 | Sand et al. | |
| 5,967,531 | A | | 10/1999 | Saillet | |
| 5,971,421 | A | | 10/1999 | Hilgarth | |
| 5,971,423 | A | * | 10/1999 | Hansen et al. | 280/634 |
| 5,975,557 | A | | 11/1999 | Snoke et al. | |
| 6,003,893 | A | | 12/1999 | Hansen | |
| 6,027,136 | A | | 2/2000 | Phillips | |
| 6,062,586 | A | | 5/2000 | Korman | |
| 6,065,770 | A | | 5/2000 | Hansen et al. | |
| 6,099,018 | A | * | 8/2000 | Maravetz et al. | 280/624 |
| 6,102,429 | A | * | 8/2000 | Laughlin et al. | 280/617 |
| 6,105,995 | A | | 8/2000 | Zill | |

(Continued)

*Primary Examiner*—Brian L. Johnson
*Assistant Examiner*—Kelly E Campbell
(74) *Attorney, Agent, or Firm*—Wolf, Greenfield & Sacks, P.C.

(57) ABSTRACT

A boot binding, such as a snowboard boot binding, where an opening through the binding that may allow passage of undesirable substances onto the floor of the binding is covered by a gasket. The gasket may be permanently or removably attached to the binding, and may be rigid or, alternatively, compliant where desired to have the gasket conform to an associated shape of the boot placed in the binding.

94 Claims, 2 Drawing Sheets

U.S. PATENT DOCUMENTS 6,109,643 A 8/2000 Bayer et al.
6,113,127 A 9/2000 Karol
6,123,342 A 9/2000 Grell
6,123,354 A * 9/2000 Laughlin et al. ..... 280/617
6,126,179 A 10/2000 Dodge
6,135,486 A 10/2000 Neiley
6,138,384 A * 10/2000 Messmer ..... 36/89
6,155,577 A * 12/2000 Okajima ..... 280/14.21
6,155,591 A 12/2000 Huffman et al.
6,164,682 A 12/2000 Okajima et al.
6,168,183 B1 1/2001 Turner et al.
6,189,913 B1 2/2001 Morrow et al.
6,196,559 B1 * 3/2001 Cress ..... 280/14.22
6,199,893 B1 3/2001 Fumagalli
6,206,403 B1 3/2001 Black et al.
6,213,493 B1 4/2001 Korman
6,234,988 B1 5/2001 Brother et al.
6,293,577 B1 * 9/2001 Shields ..... 280/617
6,328,328 B1 * 12/2001 Finiel ..... 280/636
6,402,164 B1 * 6/2002 Gonthier ..... 280/14.22
6,520,511 B2 * 2/2003 Gonthier ..... 280/11.36

* cited by examiner

SNOWBOARD BOOT BINDING

FIELD OF INVENTION

This invention relates to a snowboard boot binding.

BACKGROUND OF THE INVENTION

Commercially available snowboard boot bindings typically include a baseplate having a floor for receiving the snowboard boot and a heel hoop which surrounds the lower leg of the rider. A snowboard binding is mounted in a direction essentially across the edges of the board so, unlike in skiing where the ski binding is mounted in a tip to tail direction, a rider's toes point towards one edge of the board ("toe side edge") while her heels are positioned relative to the other edge of the board ("heel side edge"). A board is tipped on either the toe side edge or the heel side edge to steer the board when carving a turn. Because a rider's heels may overhang the heel side of the board, the binding may drag in the snow when the board is tipped onto its heel side edge ("heel drag"), slowing the speed of the rider and potentially impairing the rider's control of her board. To specifically alleviate heel drag, many bindings are configured with a cut-out or opening at the rear end of the baseplate floor at the transition to the heel hoop. Truncation of the floor at the heel end of the binding provides additional clearance between the bottom of the snowboard boot and the snow surface, allowing a board to be ridden at a greater heel side angle before contact is made between the binding/boot and the snow and, consequently, decreasing the occurrence of heel drag. An opening also is provided below the heel hoop which is adapted to receive a heel end of the snowboard boot, allowing the rider's leg to snugly fit in the binding and readily contact the heel hoop and a highback that may be provided at the rear of the binding which projects upwardly and acts as a lever against which a rider may flex her legs to put a board on heel side edge.

Snow may enter the binding through the opening below the heel hoop and through the opening in the baseplate floor frontward of the heel hoop, and such snow may accumulate on the floor of the binding potentially affecting the ability to properly seat a boot in the binding. This inconvenience is compounded in snowboarding where a rider must reengage her front foot to the front binding each time she exits a chairlift, and both feet to the front and rear bindings after she rides a gondola up the mountain. Typically, a rider digs the heel side edge of her board into the snow when positioning her feet in the binding and securing the boot engagement straps or step-in binding engagement mechanisms, causing snow to build-up on at least the heel side of the baseplate floor. It is common, then, for a rider to have to brush off her baseplate before engaging her boot in a binding.

SUMMARY OF THE INVENTION

It has been recognized by the inventors that certain openings formed in a boot binding to receive or otherwise accommodate a heel end of a boot to alleviate heel drag, or for other reasons, may allow undesired materials to enter through such openings and accumulate on the floor of the boot binding. In one aspect of the present invention, a "gasket" is provided that partially or completely covers an opening in the binding where the undesired materials may gain entrance. For example, in a snowboard boot binding a gasket may be provided that covers all or part of the opening between the floor of the baseplate and the heel hoop. Snow that is forced against the binding as the heel side edge is driven into the snow during engagement of a boot in a binding is prevented or limited by the gasket from passing through the heel side opening and onto the floor of the baseplate.

In the inventive snowboard binding, a snow gasket is provided that at least partially covers the heel side opening, blocking the passageway from the back of the binding to the baseplate floor. As explained below, the snow gasket may be flexible or rigid, pliable or non-conforming, depending upon the particular application where the snow gasket is used. The snow gasket may be an impervious structure, such as a rubber or other solid elastomeric sheet, may be porous such as when formed of a knitted or woven fabric, for example a mesh fabric, and may include large openings such as a grille arrangement where elongated slots are separated by large ribs, providing a baffle type affect for preventing snow passage or at least limiting the amount of snow that gains access to the baseplate floor. The design of the snow gasket is not restricted to the representative arrangements just mentioned, with other types and configurations of snow gaskets also contemplated for use in the inventive binding, as should be apparent to one of skill in the art.

In one embodiment of the invention, a snowboard boot binding is provided including a base having a foot receiving area and including a floor that is constructed and arranged for mounting the snowboard boot binding to a snowboard. The snowboard binding also includes a rear support member for surrounding at least a portion of a rider's leg and which extends rearwardly and upwardly from the base floor. An opening extends between a rearward edge of the base floor and the rear support member that is adapted to receive at least a portion of a heel end of a snowboard boot that has been inserted into the snowboard boot binding. The binding also includes a snow gasket for covering at least a portion of the opening, preventing snow from passing through the opening and accumulating on the base floor. The binding also is arranged with a boot engagement member for securing the snowboard boot to the snowboard boot binding.

In another embodiment of the invention, a snowboard boot binding includes a baseplate having a floor for mounting the binding to a snowboard, a medial sidewall, a lateral sidewall, and a heel hoop for surrounding at least a portion of a rider's leg and which extends rearwardly and upwardly from the baseplate floor. An opening extends between the heel hoop and a rearward edge of the floor that is adapted to receive at least a portion of a heel end of a snowboard boot that has been inserted into the boot binding. A snow gasket is mounted to the baseplate and includes a floor with a bottom surface that is located above a bottom surface of the rearward edge of the baseplate floor. A boot engagement member is provided on the binding for securing the snowboard boot.

In another embodiment of the invention, a snowboard boot binding comprises a baseplate including a floor for mounting the binding to a snowboard. The baseplate also has a medial sidewall and a lateral sidewall, and includes an at least partially enclosed heel end that is adapted to receive at least a portion of a heel end of a snowboard boot that has been inserted into the snowboard boot binding. The floor has a substantially planar mid-foot region, wherein a bottom surface of the enclosed heel end extends above a bottom surface of the planar baseplate floor at the mid-foot region. The binding also includes a boot engagement member for securing the snowboard boot to the binding.

In a further embodiment of the invention, a snowboard boot binding includes a baseplate having a floor for mounting the binding to a snowboard. The baseplate has a rigid medial sidewall, a rigid lateral sidewall, and an at least partially enclosed heel end that is adapted to receive at least a portion of a heel end of a snowboard boot that has been inserted into the snowboard boot binding. The at least partially enclosed heel end has a variable shape. The binding is provided with at least one boot engagement member for securing a snowboard boot to the binding.

In a further embodiment of the invention, there is provided a snowboard boot binding having a baseplate with a floor for mounting the binding to a snowboard, a medial sidewall, and a lateral sidewall, wherein the floor has a mid-foot region. An at least partially enclosed heel end of the binding is adapted to receive at least a portion of a heel end of a snowboard boot that has been inserted into the baseplate. The at least partially enclosed heel end is formed of a different material than any of the medial sidewall, the lateral sidewall and the floor mid-foot region. The binding has at least one boot engagement member for securing a snowboard boot to the snowboard binding.

In a still further embodiment of the invention, a snowboard boot binding includes a baseplate arranged with a floor for mounting the binding to a snowboard, a medial sidewall, a lateral sidewall, and a heel hoop for surrounding at least a portion of a rider's leg and which extends rearwardly and upwardly from the baseplate floor. An opening extends between a rearward edge of the baseplate floor and the heel hoop. A snow gasket is attached to the binding and extends at least partially between the heel hoop and the baseplate floor. The snow gasket is a distinct and independent component from the heel hoop and the baseplate floor. A boot engagement member is arranged in the binding for securing the snowboard boot.

A further embodiment of the invention is a method of assembling a snowboard boot binding, including the step of providing a binding baseplate including a floor, a medial sidewall, a lateral sidewall, and a heel hoop for surrounding at least a portion of a rider's leg and which extends rearwardly and upwardly from the baseplate floor, wherein an opening extends between the heel hoop and a rearward edge of the baseplate floor that is adapted to receive at least a portion of a heel region of a snowboard boot inserted into the snowboard boot binding. At least a portion of the opening is then covered with a snow gasket to prevent snow from passing through the opening and accumulating on the baseplate floor.

BRIEF DESCRIPTION OF THE DRAWINGS

Illustrative embodiments are described in connection with the following drawings, in which like numerals reference like elements, and wherein.

DETAILED DESCRIPTION

Figure 1:
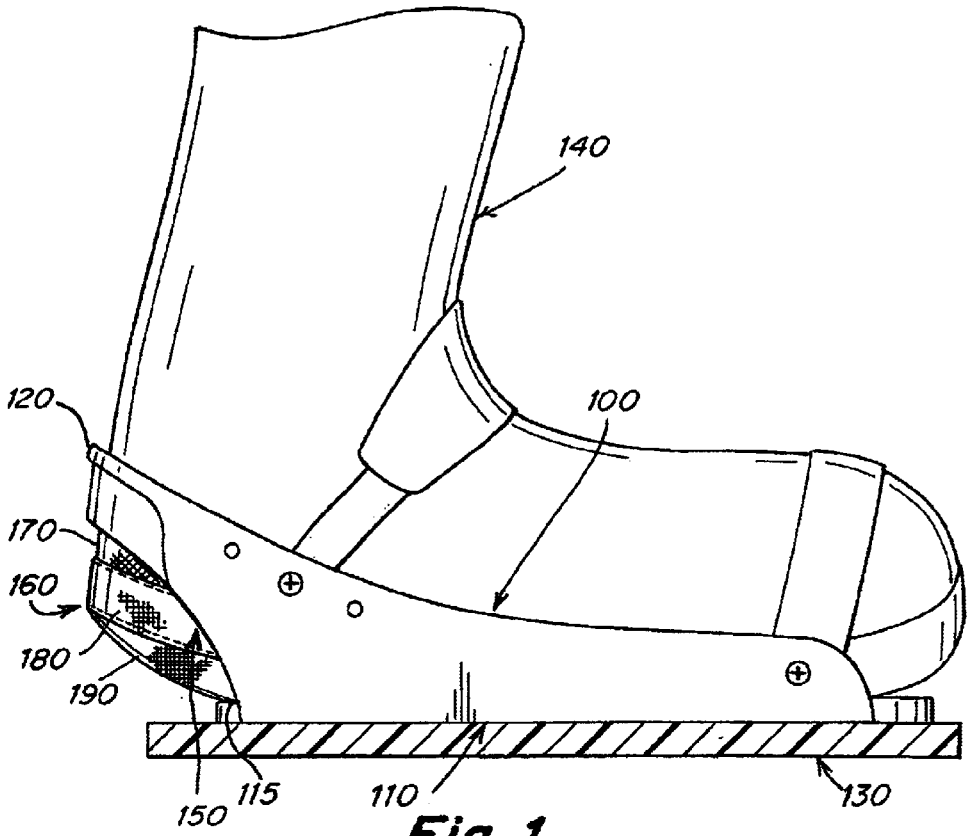
FIG. 1 is a side view of a snowboard binding showing an illustrative embodiment of a gasket.

The invention is directed to a binding for a foot, boot, or shoe and, for purposes of this specification including the claims, the term "boot" shall encompass not only a boot, but also a foot, shoe, and other footwear. Further, although the invention is described here in connection with a snowboard boot binding, the inventive arrangement is not so limited, and may be embodied in other devices where a boot is secured including, without limitation, a ski binding, snow shoe, snowskate, snowscooter, and the like. Also, the invention is not limited to a binding used on a device that glides only over snow. Boot bindings used in devices that glide over water, sand, ice, dirt, asphalt, and other surfaces also are within the scope of this invention.

One aspect of the present invention is preventing, or limiting, the accumulation of snow, ice, debris and/or other substances on the floor of a snowboard boot binding. In certain embodiments, another aspect of the present invention is reducing the occurrence of heel drag when a board is ridden on its heel side edge. Although a snow gasket may be arranged on a binding to keep snow off of the baseplate and also may be arranged on a binding to address heel drag properties, the present invention does not require both aspects in all inventive embodiments. For example, a snowboard binding may include a baseplate with a floor that extends all the way beneath the rearward most end of a heel hoop, so that a snow gasket extending between the surface of the baseplate floor and the heel hoop does not project rearwardly of the heel end of the baseplate. While the snow gasket in the just described embodiment would help keep snow from building up on the binding floor, the position of the snow gasket would have negligible, if any, affect on the heel drag properties of the binding. Similarly, a snow gasket described in various embodiments herein is pliable, conforming to the contours of a heel end of a snowboard boot that has been inserted into the binding, for example when a NEOPRENE sheet or three dimensional hollow shape is positioned at least partially across the heelside opening between the heel hoop and the baseplate floor. While conformance of the NEOPRENE gasket to the profile of the boot may help minimize the occurrence of heel drag, it is not necessary for the snow gasket to present a slender profile to perform a snow blocking function. Consequently, in certain embodiments of the invention the snow gasket is made of a rigid, non-pliable material, or may otherwise present a profile that either does not influence the heel drag resistance of the binding or may decrease the heel drag character of the binding.

In certain embodiments, a thin pliable gasket covers an opening in the heel portion of a foot binding. The pliable gasket may closely conform to a contour of the boot heel and therefore results in a slight heel side profile that is close to that of the boot heel itself. The pliable gasket may include a supple material, such as a natural or synthetic fabric or leather, that would allow the gasket to accommodate different heels of different boots. The pliable gasket may also include a stretchable material, such as rubber, or other elastomeric material, or a stretchable fabric such as LYCRA or NEOPRENE, that allows the gasket to stretch about the heel end as the boot is inserted into the binding, closely conforming to the heel so that the gasket only projects a negligible distance rearwardly so as not to adversely affect heel side drag when the board is put on heelside edge. The gasket may also be made thinner, or of a less dense material, than the binding so that an enclosed heel end may be provided with less weight than prior bindings having a fully molded heel area.

As observed earlier, in certain embodiments of the invention the gasket may be formed of a non-pliable material, such as a hard plastic. This non-pliable gasket may be pre-formed to approximate the contours of one or more particular boots. The outer surface of the non-pliable gasket may be shaped to enhance resistance to heel drag, for example by providing the rear wall of the gasket with a linear or curved profile, depending on the shape of the boot, the clearance required, and the rider's preference. The non-pliable gasket may also be formed integrally with the binding, thus reducing the complexity of the binding and eliminating the possibility that the gasket may become inadvertently detached from the binding. The non-pliable gasket may include a floor having a bottom surface that is located above the bottom surface of the adjacent rearward edge of the baseplate, so that the gasket provides an attractive heel drag profile.

The gasket may be mounted to the binding so that some or all of the heelside opening is sealed. Portions of the gasket may be attached to the heel hoop, sidewalls, and/or baseplate floor, whether on inside surfaces, outside surfaces, edges or combinations of any such portions of the binding. The snow gasket may be permanently attached to the binding or, alternatively, may be removably mounted to the binding. In certain embodiments, both the binding and the snow gasket may include complementary engagement members, while in other embodiments the attachment mechanism may be arranged on only one of the components. For example, and without limiting the attachment systems contemplated for the inventive binding, a VELCRO hook and loop system may be employed with one of the hook and loop surfaces being provided, such as in an adhesive backed strip form, on an outer surface of the snow gasket with the complementary other of the hook and loop fabric strips being located on an inner surface of the heel hoop. The removable aspect of the invention allows replacement of the gasket should it become worn or for aesthetic or other reasons. For example, gaskets may be changed in accordance with a desired color scheme, e.g., to match the color of a rider's binding, boots, etc., or to display one or more logos, brand names or other personalized information. The gasket also may include two or more segments having different properties. For example, a lower portion of the gasket may have enhanced durability, while an intermediate portion may have better abrasion resistance, while a top portion may have notable stretch characteristics. In certain embodiments, these or other performance properties of the gasket may be locally varied to provide the desired, specialized performance attributes. For example, a segment of the gasket may include stretchy or elastic material such as NEOPRENE, while another portion of the gasket may be formed of, or contain, a durable fabric particularly at areas likely to encounter high stress or wear, such as the outside of the gasket or the edge of the sole of the boot. In certain embodiments, the gasket may be waterproof or highly water resistant, preventing moisture from entering the binding through the heel opening and thus reducing the possibility that ice might accumulate inside the binding.

In certain embodiments, the gasket may selectively be unseated from the binding, allowing a rider to insert a hand through the exposed opening normally covered by the gasket, e.g., to use the heel hoop of the binding as a handle to carry the board. The gasket may include a resilient material and/or include a resilient structure so that when the rider releases the gasket, it reverts back into a position covering the opening.

Figure 2:
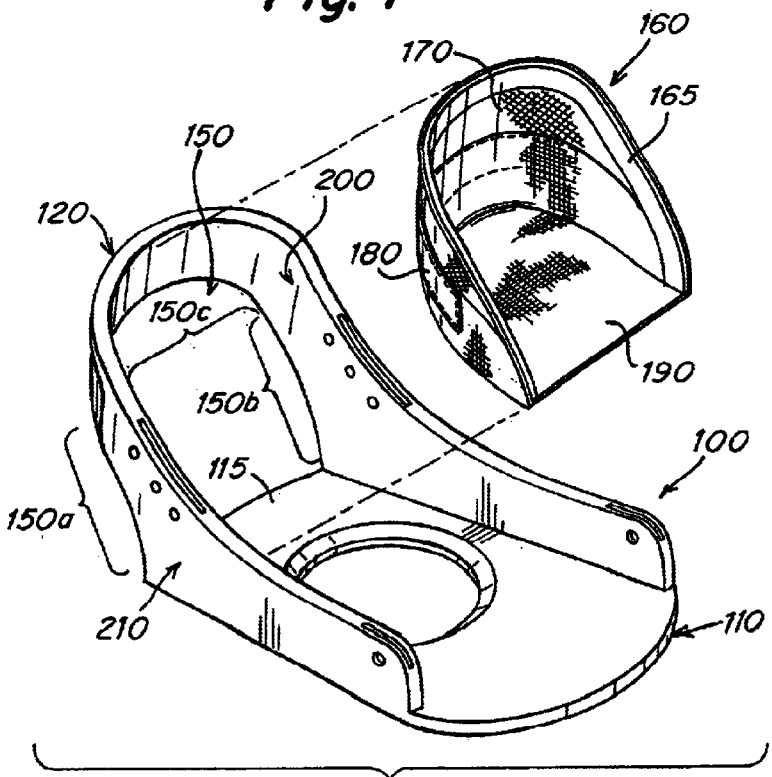
FIG. 2 is an exploded perspective view of a snowboard binding showing an illustrative embodiment of a gasket.

Turning to the drawings, FIGS. 1–4 show an illustrative embodiment of a snowboard binding including a snow gasket. The binding 100 includes a baseplate 110 and a rear support member 120 that surrounds at least the back of a rider's leg, e.g., a heel hoop. The binding floor 115 may have, as shown, a substantially planar bottom for mounting to a surface of a snowboard 130, and has a boot receiving area for accepting a boot 140. The baseplate may include one or more holes that are registrable with an insert pattern in a snowboard. Tightening of fastener inserts extending through the holes and into the board, will mount the binding to the board. The baseplate may be provided with an aperture, as shown in FIG. 2, adapted to receive a hold down disc (not shown) that will carry the holes for receiving the fasteners that connect the binding to the board as is commonly provided in snowboard boot bindings. Boot engagement members, such as one or more straps, or strap-less engagement arrangements (e.g., step-in binding mechanisms), may be provided to secure the boot in the binding. A highback or other leg support member may be mounted to the rear of the baseplate and may include a forward lead adjuster or other surface that abuts against the top or other surface of the heel hoop, allowing rearward flexing of the rider's leg against the highback to transmit forces down the highback, through the heel hoop, along the baseplate to the insert hardware and, ultimately, to the board.

An opening 150 is formed between a rearward edge of the floor 115 of base 110 and the rear support member 120. As shown in FIG. 1, when a snowboard boot is seated in the binding, a heel end of the boot projects into the opening 150. A gasket 160 is arranged to cover at least a portion of the opening 150. As illustrated, the gasket 160 covers the entire opening, extending from one side of the opening to the other, and from the top of the opening to the bottom. However, the invention is not limited to an embodiment where the gasket fully covers the heelside opening. Embodiments are contemplated where the gasket extends completely from side to side, but not fully from top to bottom, and from top to bottom but not completely from side to side. Other embodiments are directed at covering various sections of the opening with the gasket while leaving other sections of the opening exposed. While the gasket is illustrated as a single member, the coverage of the opening, whether full or partial, may instead be provided by one or more individual, discrete gasket elements.

In the embodiment shown, the gasket includes a rear wall having a lower portion that ends forwardly of the rearmost extent of the heel hoop, a lateral wall, a medial wall, and a floor. The bottom of the floor of the illustrated gasket is located above the bottom of the floor at the rearward edge of the baseplate. Accordingly, when the board is tipped on its heel side edge, the snow gasket provides a beneficial heel drag profile as compared to an arrangement where the baseplate floor would have been extended along its current plane to beneath the rearmost extent of the heel hoop. Because the bottom of the baseplate floor so extended would hover below the bottom of the snow gasket, the baseplate floor so modified would drag against the snow at a smaller on-edge angle than the angle at which the snow gasket would contact the snow.

The particular configuration of the opening is not critical to the invention, and the size and shape of the heelside opening may vary as would be apparent to one of skill in the art. In the illustrated embodiment, as shown perhaps most clearly in FIG. 2, the opening 150 has a lateral side 150*a*, a medial side 150*b* and a rear side 150*c* that are defined by the rear support member and the binding floor. While the figures depict a heel hoop as the rear support member 120, the rear support member 120 is not limited only to a heel hoop and may instead be a highback or any other structure that, in cooperation with the baseplate 110, forms an opening 150 for receiving a portion of the heel of the boot 140. A rear support member, such as a heel hoop, may be formed integrally with the base, such as by molding, or may be formed separately and then attached to the base 110, such as via a friction fit or by any suitable fastening arrangement, including, for example, a nut and bolt, adhesive, welding, etc., or may be separate from and not directly attached to the base 110. The base 110 and rear support member 120 may be constructed of any suitable material or materials used for bindings, including metal and plastic, and the base 110 and rear support member 120 may be constructed of the same or different materials.

As shown in FIG. 2, the base 110 and rear support member 120 define an inside surface 200, against which, or at least adjacent to, at least a portion of the boot 140 may be positioned, as well as an outside surface 210 opposite the inside surface. In this illustrative embodiment, the gasket 160 is shaped to cover fully the opening 150 such that the peripheral edges of gasket 160 abut portions of the inside surface 200. As described earlier, the gasket need not cover the entire opening, and embodiments are contemplated where the edges of the gasket do not completely surround the edges of the heel hoop and the baseplate sidewalls that defining the opening 150, as should be apparent to one of skill in the art. Although the gasket is illustrated as being mounted about the inside surface 200, the gasket also may be mounted about the outside surface 210, to the bottom edges of one, or more, of the heel hoop the lateral sidewall and the medial sidewall. Any surface of the gasket may be attached to the baseplate. As an example, the gasket 160 may be secured to the floor 115 of the baseplate and may extend either under or over a heel pad (not shown), if provided. Alternately, the gasket may be formed integrally with a heel pad so that the gasket 160 is secured to the base 110 by securing the heel pad in place. In other embodiments, the gasket 160 may not be firmly attached to the binding.

In certain embodiments of the invention, the gasket 160 is formed from different materials, and/or is provided with different properties along various regions of the gasket. For example, the gasket 160 may be constructed from one or more of the following materials: natural fabrics, rubber, hard or soft plastics, synthetic fabrics such as NYLON, LYCRA, NEOPRENE, or GORE-TEX, and other appropriate material as would be apparent to one skilled in the art. Employing two or more materials in the gasket may result in beneficial properties at predetermined regions of the gasket.

In the illustrative embodiment shown in FIGS. 1–4, the gasket 160 includes a rear wall, a medial wall, a lateral wall and a floor, presenting a self supporting, cup shape for receiving a heel end of a snowboard boot. Four segments with different properties are provided. An upper stretchable, yet resilient, segment 170 will tightly conform with the shape of the boot, urging the lower and intermediate segments against the heel. NEOPRENE and other stretchable fabrics may be employed in the upper segment, and the gasket 160 may be slightly smaller, in at least one dimension, than a heel end of a boot to be received so that the gasket 160 stretches upon seating of the boot in the binding, conforming the gasket 160 closely to the contour of the boot heel so as not to adversely affect the heel drag properties of the binding. An intermediate segment 180 may include an outer abrasion resistant surface, such as provided by CORDURA, and the like, to resist wear on the gasket due to contact by the gasket with ice, rocks, dirt, sticks, and the like. A lower segment 190 that is particularly durable is provided along the floor and lower wall sections of the gasket.

A rim 165 or frame-like structure may be employed to impart structure, or to help the gasket keep its shape, as well as to aid or provide physical properties to the gasket. The rim may be made of a resilient material and shaped in such a way as to help maintain the gasket in, or return the gasket to, a position covering the opening. In the embodiment illustrated, the rim 165 is made of a thin strip of plastic, metal or other resilient material. The rim 165 may extend around the top edge of the upper segment 170 and along the front of the lower segment 190. Portions of the gasket may be overlapped and hemmed to form a pocket for receiving the rim. Alternatively, the rim may be joined to the gasket by stitching, glue, or other attachment mechanisms as would be apparent to one of ordinary skill in the art. If a heel pad (not shown) is provided at the floor 115 of the binding, the rim 165 may extend under or over the heel pad, or be formed integrally with the heel pad. The rim 165 may be secured to the rear support member 120 or at the floor 115. For example, the rim 165 may circumscribe the entire opening 150 and be arranged so that it snaps in place to hold the gasket 160 over the opening 150, e.g., by engaging with a clip or other mounting feature in the base floor, sidewall and/or heel hoop. In one embodiment the rim is secured at the floor 115 or lower sides of the rear support member 120, but not at other portions of the rear support member 120, allowing a rider to draw back or push sideways the gasket as she inserts a hand through the opening 150, grabbing the rear support member 120 as a handle, for example. When the rider's hand is withdrawn from the opening, the rim 165 may resiliently revert back to its prior position, maintaining the gasket 160 back in contact with the rear support member 120, baseplate floor and/or sidewalls. In another arrangement, the upper segment 170 may extend upwardly beyond the rim 165 and over the top edge of the heel hoop so that the upper segment 170 may be pinched between the top edge of the heel hoop and the lower edge of a highback mounted to the binding 100. Pinching the upper segment 170 or other portions of the gasket 160 between the heel hoop and highback may help to keep the gasket in place.

It should be appreciated that this particular arrangement of gasket segments and the recited list of materials for constructing the gasket is not limiting of the invention, but merely discloses a representative embodiment of the present invention; the invention encompasses other arrangements and selections as would be appropriate for a particular application and apparent to one skilled in the art. Thus, a gasket may be provided with one or more of the four segments mentioned above, but need not include all four of the various segments noted. Further, although the gasket is illustrated as being separately formed from a heel pad that may be provided on the floor 115 of the binding 100, the gasket 160 may be made integral with the heel pad, if desired. As another option, all or part of the gasket 160 may be made collapsible or expandable, the gasket 160 may be made integral with a boot (i.e., so that the rear portion of the boot itself entirely encloses the opening 150), or the gasket 160 may be made to cover portions of the binding 100 other than a heel (e.g., the gasket 160 may cover areas between binding straps or at the toe of the binding).

Figure 3:
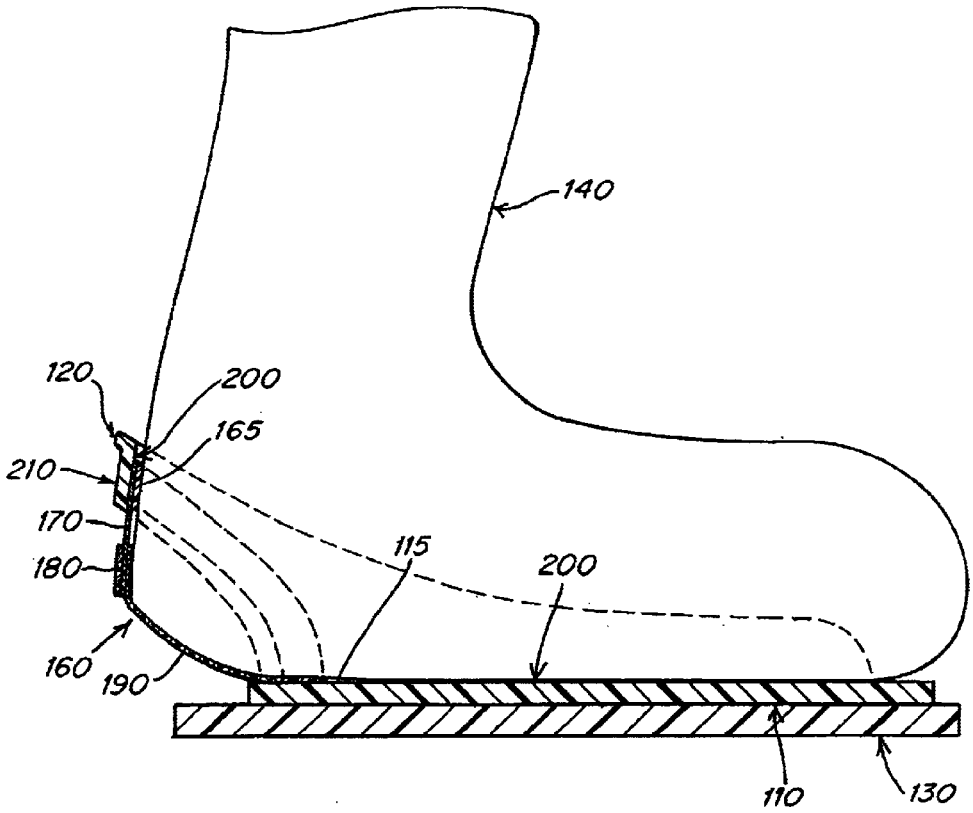
FIG. 3 is a cross-sectional view of a snowboard binding showing an illustrative embodiment of a gasket.
Figure 4:
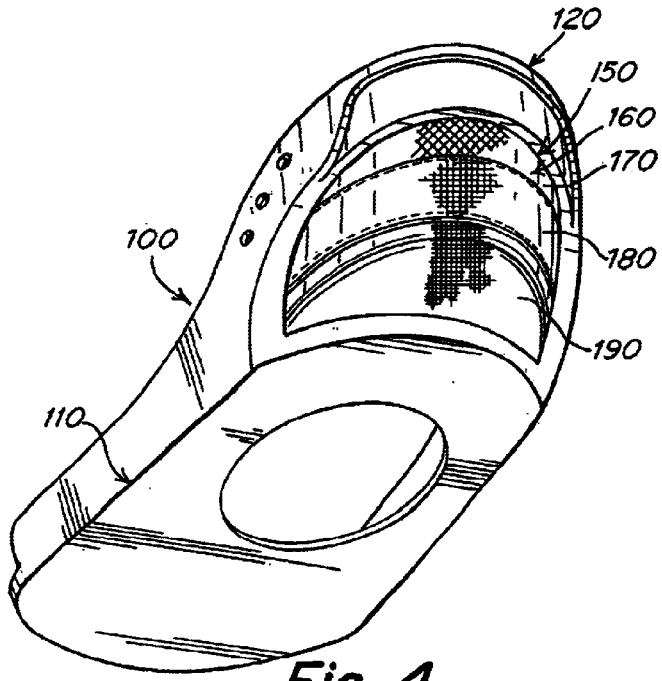
FIG. 4 is a rear perspective view of a snowboard binding showing an illustrative embodiment of a gasket.

The various segments included in a multiple-component gasket 160 may be separately formed and then joined by adhesive, stitching, rivets, or any other conventional or suitable method as would be known to one skilled in the art. A combination of joinery arrangements may also be employed, either on different joints or on the same joint for increased strength, and it may be advantageous to provide an overlap between different segments, as shown in FIG. 3, so as to increase the strength of the joint. Of course, it will be understood that the performance specific segments of the gasket 160 need not be contiguous.

In one embodiment, the method of attachment of the gasket 160 to the binding 100 may permit removal or selected movement of the gasket 160. Where the gasket 160 is removably attached, the means of attachment may be any suitable means for providing such attachment, including a friction fit, adhesive, hook-and-loop fasteners, snaps, buttons, hook-and-eye fasteners, laces or cords, zippers, magnets, or threaded fasteners. Removable attachment may also be achieved by holes, slits, straps, cords, cables, hooks, tabs or like elements integral to the gasket and constructed to mate with complementary structures, such as holes, hooks, tabs, knobs, slits, or slots, formed on the inside or outside surfaces 200, 210, of the baseplate sidewall, heel hoop, floor, and/or on the edges of the floor, heel hoop or sidewalls. In some such embodiments, the gasket 160 may be fitted with hooks, loops, tabs, handles or similar structures to facilitate removal. A removable gasket 160 may be replaced when a new boot is to be used with the binding, may be replaced if lost or worn, may be replaced for aesthetic purposes, such as where a different color scheme, texture, pattern, or logo is desired, may be moved from one binding to another, and may be removed in conditions, such as when traversing packed surfaces, where it is not needed. In this connection, it is anticipated that the gasket 160 may, in some cases, function as a novelty item, bearing various colors and/or logos used in connection with ski resorts, equipment or clothing manufacturers, and other such concerns or entities.

The gasket 160 may also be secured so that portions of the gasket, or the entire gasket, may be moved, but not necessarily removed from the binding. For example, a portion of the gasket may be pivotally attached to the binding so that it may be swung to one side, lifted up or pulled down, e.g., the rim 165 may be pivotally mounted at the floor 115 to allow a rider to rotate the rim 165 toward the toe end and gain entrance through the opening 150. In a representative pivotally mounted embodiment, the gasket may be provided with a bias that urges the gasket into position to impede snow entry through the opening, but which may be overcome allowing a rider to selectively move the gasket by hand.

Fixed attachment of the gasket 160 to the inside and/or outside surfaces 200, 210 may be achieved by permanent adhesive, stitching, rivets, screws, or any conventional or known means for providing such attachment. It should also be understood that one portion of the gasket may be permanently attached while another portion may be removably attached to the binding. Such an arrangement may allow, for example, the gasket to be temporarily moved from covering the opening to allow snow to be removed from the binding or to allow a rider to use the heel hoop as a handle, as described above. For example, a top portion of the gasket may be permanently fixed to the heel hoop while a lower portion of the gasket is releasably attachable to the floor of the baseplate. To remove snow that may have built up in the rear end of the baseplate, the lower portion of the gasket may be detached and swung away from the heelside opening, providing access for removal of snow, ice and other debris that may have accumulated on the baseplate floor.

In another illustrative embodiment, the gasket 160 may be constructed of a single material. Such a single material gasket may be made of natural fabrics, rubber, hard or soft plastic, synthetic fabrics such as NYLON, LYCRA, NEOPRENE, or GORE-TEX, or any other suitable material as would be apparent to one skilled in the art.

In another illustrative embodiment, the gasket 160 may include a pliable material. A gasket 160 having a pliable portion may closely conform to a contour of the boot heel and therefore result in a heel side profile that is close to that of the boot heel itself, potentially minimizing the possibility of heel drag. The material used in the gasket 160 can be chosen to take advantage of specific combinations of properties and characteristics, such as suppleness (a term used herein to describe flexibility with low elasticity), stretchability (a term used herein to describe flexibility coupled with higher elasticity), durability, water resistance, and cost, as well as aesthetic considerations such as color and texture. For example, natural fabric may be fairly supple and inexpensive, but not generally stretchable or durable, while leather is highly durable, but may be more expensive and is generally not highly stretchable. Synthetic materials such as LYCRA, NEOPRENE, and GORE-TEX, may offer other beneficial properties or an advantageous combination of properties. The particular material will vary depending on the particular application.

In another embodiment, the gasket 160 may include a non-pliable material, such as hard plastic. In this embodiment, the gasket 160 may be adapted to particular, predetermined boot contours, including constructions designed to be suitable for use with generic boot shapes, as well as constructions designed for specific boot shapes. That is, the gasket 160 may be preformed to closely match the contour of one or more boot heels, e.g., those made by a particular boot manufacturer, or may be custom molded to match a particular boot heel. For example, the gasket 160 may include a thermoplastic material that may be heated and then molded to a boot heel. In one embodiment, the gasket 160 may be mounted to the binding and the moldable portion of the gasket 160 heated. The rider's boot may then be placed in the binding so that the moldable portion of the gasket 160 assumes the shape of the boot heel. Once cooled, the moldable portion may retain the molded shape. It will be understood that such custom molding may be achieved in other ways, such as by using thermoset polymers, epoxy formulations, etc. The non-pliable gasket may be fixedly or removably attached to the binding using any suitable means, as described above. Particularly appropriate means of attaching the non-pliable embodiment may be a snap or friction fit or threaded fasteners. In some embodiments, the non-pliable gasket may be integral to the base 110 and/or the rear support member 120, a construction that may reduce the complexity of the binding 110 and eliminate the possibility that the gasket 160 might be inadvertently dislodged or lost.

Having described certain embodiments of the present invention, various alterations, modifications, and improvements will readily occur to those skilled in the art. It should be understood that structure and composition of the gasket can vary from the illustrative embodiments described above. In addition, the invention is not limited to use with snowboards, but may be used with other types of bindings, such as those used for snowshoes, skis, or other applications in which a foot is bound to a device other than a snowboard. Therefore, such alterations, modifications and improvements are intended to be within the sprit and scope of the invention. Accordingly, the foregoing description is by way of example only, and not intended to be limiting.

What is claimed is:

1. A snowboard boot binding, comprising:

a base having a foot receiving area and including a floor that is constructed and arranged for mounting said snowboard boot binding to a snowboard, said snowboard binding including a rear support member for surrounding at least a portion of a rider's leg and which extends rearwardly and upwardly from said base floor, wherein an opening extends between a rearward edge of said base floor and said rear support member, said opening adapted to receive at least a portion of a heel end of a snowboard boot that has been inserted into said snowboard boot binding;

a snow gasket, mounted to the base, for covering at least a portion of said opening to prevent snow from passing through said opening and accumulating on said base floor, the snow gasket being separate from a snowboard boot; and a boot engagement member for securing the snowboard boot to said snowboard boot binding.

2. The snowboard boot binding recited in claim 1, wherein said rear support member is a heel hoop.

3. The snowboard boot binding recited in claim 2, wherein said rear support member is integrally formed with said base.

4. The snowboard boot binding recited in claim 2, wherein said rear support member is a separate and distinct component from said base.

5. The snowboard boot binding recited in claim 1, wherein said snow gasket includes a floor and a bottom of said snow gasket floor is located above a bottom of said rearward edge of said base floor.

6. The snowboard boot binding recited in claim 1, wherein said snow gasket includes a rear wall, a lateral sidewall, a medial sidewall, and a floor.

7. The snowboard boot binding recited in claim 1, wherein said snow gasket includes a frame.

8. The snowboard boot binding recited in claim 1, wherein said snow gasket has a variable shape.

9. The snowboard boot binding recited in claim 1, wherein said snow gasket is compliant and will assume the general shape of a heel end of said snowboard boot upon insertion of said snowboard boot into said snowboard boot binding.

10. The snowboard boot binding recited in claim 1, wherein said snow gasket is removably attached to said base.

11. The snowboard boot binding recited in claim 1, wherein said snow gasket includes a material selected from the group of natural fabrics, plastic fabrics, elastomeric fabrics, and combinations of any of the foregoing.

12. The snowboard boot binding recited in claim 11, wherein said snow gasket includes a mesh-type fabric.

13. The snowboard boot binding recited in claim 1, wherein said base includes a medial sidewall and a lateral sidewall, and said snow gasket extends from at least one of said medial sidewall, said lateral sidewall, and said base floor.

14. The snowboard boot binding recited in claim 13, wherein said snow gasket extends from two of said medial sidewall, said lateral sidewall, and said base floor.

15. The snowboard boot binding recited in claim 13, wherein said snow gasket extends from said medial sidewall, said lateral sidewall, and said base floor.

16. The snowboard boot binding recited in claim 1, wherein said snow gasket includes a predetermined region having a property different from another region of said snow gasket, said property including at least one of durability, abrasion resistance, and stretch.

17. The snowboard boot binding recited in claim 16, wherein an upper portion of said snow gasket has a different stretch property as compared to a lower or intermediate portion of said snow gasket.

18. The snowboard boot binding recited in claim 16, wherein said intermediate portion of said snow gasket has a different abrasion resistance property as compared to each of a top portion and a lower portion of said snow gasket.

19. The snowboard boot binding recited in claim 16, wherein said lower portion has a different durability property as compared to each of an intermediate portion and an upper portion of said snow gasket.

20. The snowboard boot binding recited in claim 1, wherein said snow gasket includes a lower end and an upper end, and said snow gasket is biased towards said upper end.

21. The snowboard boot binding recited in claim 1, wherein said boot engagement member includes at least one of a strap-type member and a strapless member.

22. A snowboard boot binding, comprising:

a baseplate including a floor for mounting to a snowboard, a medial sidewall, a lateral sidewall, and a heel hoop for surrounding at least a portion of a rider's leg and which extends rearwardly and upwardly from said baseplate floor, wherein an opening extends between said heel hoop and a rearward edge of said floor that is adapted to receive at least a portion of a heel end of a snowboard boot that has been inserted into said snowboard boot binding;

a snow gasket mounted to said baseplate, positioned at least partially in said opening, the snow gasket being separate from a snowboard boot and having a floor with a bottom surface that is located above a bottom surface of said rearward edge of said baseplate floor; and a boot engagement member for securing the snowboard boot to said snowboard boot binding.

23. The snowboard boot binding recited in claim 22, wherein said snow gasket includes a frame.

24. The snowboard boot binding recited in claim 22, wherein said snow gasket has a variable shape.

25. The snowboard boot binding recited in claim 22, wherein said snow gasket is compliant and will assume the general shape of a heel end of said snowboard boot upon insertion of said snowboard boot into said snowboard boot binding.

26. The snowboard boot binding recited in claim 22, wherein said snow gasket is removably mounted to said base.

27. The snowboard boot binding recited in claim 22, wherein said snow gasket includes a material selected from the group of natural fabrics, plastic fabrics, elastomeric fabrics, and combinations of any of the foregoing.

28. The snowboard boot binding recited in claim 27, wherein said snow gasket includes a mesh-type fabric.

29. The snowboard boot binding recited in claim 22, wherein said snow gasket extends from at least one of said medial baseplate sidewall, said lateral baseplate sidewall, and said baseplate floor.

30. The snowboard boot binding recited in claim 29, wherein said snow gasket extends from two of said medial baseplate sidewall, said lateral baseplate sidewall and said baseplate floor.

31. The snowboard boot binding recited in claim 29, wherein said snow gasket extends from said medial sidewall, said lateral sidewall, and said base floor.

32. The snowboard boot binding recited in claim 22, wherein said snow gasket includes a predetermined region having a property different from another region of said snow gasket, said property including at least one of durability, abrasion resistance, and stretch.

33. The snowboard boot binding recited in claim 32, wherein an upper portion of said snow gasket has a different stretch property as compared to a lower or intermediate portion of said snow gasket.

34. The snowboard boot binding recited in claim 32, wherein said intermediate portion of said snow gasket has adifferent abrasion resistance property as compared to each of a top portion and a lower portion of said snow gasket.

35. The snowboard boot binding recited in claim 32, wherein said lower portion of said snow gasket has a different durability property as compared to each of an intermediate portion and an upper portion of said snow gasket.

36. The snowboard boot binding recited in claim 22, wherein said snow gasket includes a lower end and an upper end, and said snow gasket is biased towards said upper end.

37. The snowboard boot binding recited in claim 22, wherein said boot engagement member includes at least one of a strap-type member and a strapless member.

38. A snowboard boot binding, comprising:

a baseplate including a floor for mounting said binding to a snowboard and having a medial sidewall and a lateral sidewall, said baseplate including an at least partially enclosed heel end, separate from a snowboard boot and mounted to the baseplate, with a heel end floor having a bottom surface that is adapted to receive at least a portion of a heel end of a snowboard boot that has been inserted into said snowboard boot binding, said baseplate floor having a substantially planar mid-foot region, wherein the bottom surface of said heel end floor extends above a bottom surface of said baseplate floor at said planar mid-foot region; and a boot engagement member for securing the snowboard boot to said snowboard boot binding.

39. The snowboard boot binding recited in claim 38, wherein said at least partially enclosed heel end includes a heel hoop for surrounding at least a portion of a rider's leg, said heel hoop extending rearwardly and upwardly from said baseplate floor, and an opening extending between a rearward edge of said baseplate floor and said heel hoop.

40. The snowboard boot binding recited in claim 39, wherein said at least partially enclosed heel end includes a snow gasket at least partially covering said opening.

41. The snowboard boot binding recited in claim 40, wherein said snow gasket completely covers said opening.

42. The snowboard boot binding recited in claim 40, wherein said snow gasket has a cup shape.

43. The snowboard boot binding recited in claim 40, wherein said snow gasket includes a frame.

44. The snowboard boot binding recited in claim 40, wherein said snow gasket has a variable shape.

45. The snowboard boot binding recited in claim 40, wherein said snow gasket is compliant and will assume the general shape of a heel end of said snowboard boot upon insertion of said snowboard boot into said snowboard boot binding.

46. The snowboard boot binding recited in claim 40, wherein said snow gasket is removably attached to said baseplate.

47. The snowboard boot binding recited in claim 40, wherein said snow gasket includes a material selected from the group of natural fabrics, plastic fabrics, elastomeric fabrics, and combinations of any of the foregoing.

48. The snowboard boot binding recited in claim 47, wherein said snow gasket includes a mesh-type fabric.

49. The snowboard boot binding recited in claim 40, wherein said snow gasket extends from at least one of said medial sidewall, said lateral sidewall, and said baseplate floor.

50. The snowboard boot binding recited in claim 49, wherein said snow gasket extends from two of said medial sidewall, said lateral sidewall and said base floor.

51. The snowboard boot binding recited in claim 49, wherein said snow gasket extends from said medial sidewall, said lateral sidewall, and said baseplate floor.

52. The snowboard boot binding recited in claim 40, wherein said snow gasket includes predetermined region having a property different from another region of said snow gasket, said property including at least one of durability, abrasion resistance, and stretch.

53. The snowboard boot binding recited in claim 52, wherein an upper portion of said snow gasket has a different stretch property as compared to a lower or intermediate portion of said snow gasket.

54. The snowboard boot binding recited in claim 52, wherein said intermediate portion of said snow gasket has a different abrasion resistance property as compared to each of a top portion and a lower portion of said snow gasket.

55. The snowboard boot binding recited in claim 52, wherein said lower portion of said snow gasket has a different durability property as compared to each of an intermediate portion and an upper portion of said snow gasket.

56. The snowboard boot binding recited in claim 40, wherein said snow gasket includes a lower end and an upper end, and said snow gasket is biased towards said upper end.

57. The snowboard boot binding recited in claim 38, wherein said boot engagement member includes at least one of a strap-type member and a strapless member.

58. A snowboard boot binding, comprising:

a baseplate including a floor for mounting said snowboard boot binding to a snowboard, a medial sidewall, a lateral sidewall, a heel hoop for surrounding at least a portion of a rider's leg and which extends rearwardly and upwardly from said baseplate floor, and an opening extending between a rearward edge of said baseplate floor and said heel hoop;

a snow gasket mounted to the baseplate and extending at least partially between said heel hoop and said baseplate floor, said snow gasket being a distinct and independent component from said heel hoop and said baseplate floor and being separate from a snowboard boot; and a boot engagement member for securing said snowboard boot to said snowboard boot binding.

59. The snowboard boot binding recited in claim 58, wherein said snow gasket is rigid.

60. The snowboard boot binding recited in claim 58, wherein said snow gasket has an outer shape that plugs said opening.

61. The snowboard boot binding recited in claim 58, wherein said snow gasket is made from the same material as at least one of said heel hoop and said baseplate floor.

62. The snowboard boot binding recited in claim 61, wherein said snow gasket has a floor and an edge adjacent said rearward edge of said baseplate floor, and wherein a bottom of said snow gasket floor at said adjacent edge is located above a bottom of said rearward edge of said baseplate floor.

63. The snowboard boot binding recited in claim 58, wherein said snow gasket completely covers said opening.

64. The snowboard boot binding recited in claim 58, wherein said snow gasket has a cup shape.

65. The snowboard boot binding recited in claim 58, wherein said snow gasket includes a frame.

66. The snowboard boot binding recited in claim 58, wherein said snow gasket is less rigid than said medial sidewall and said lateral sidewall.

67. The snowboard boot binding recited in claim 58, wherein said snow gasket is compliant and will assume the general shape of a heel end of said snowboard boot upon insertion of said snowboard boot into said snowboard boot binding.

68. The snowboard boot binding recited in claim 58, wherein said snow gasket is removably attached to said baseplate.

69. The snowboard boot binding recited in claim 58, wherein said snow gasket is selected from the group of natural fabrics, plastic fabrics, elastomeric fabrics, and combinations of any of the foregoing.

70. The snowboard boot binding recited in claim 69, wherein said snow gasket includes a mesh-type fabric.

71. The snowboard boot binding recited in claim 58, wherein said snow gasket extends from at least one of said medial sidewall, said lateral sidewall, and said baseplate floor.

72. The snowboard boot binding recited in claim 71, wherein said snow gasket extends from two of said medial sidewall, said lateral sidewall, and said baseplate floor.

73. The snowboard boot binding recited in claim 71, wherein said snow gasket extends from said medial sidewall, said lateral sidewall, and said baseplate floor.

74. The snowboard boot binding recited in claim 58, wherein said snow gasket includes a predetermined region having a property different from another region of said snow gasket, said property including at least one of durability, abrasion resistance, and stretch.

75. The snowboard boot binding recited in claim 74, wherein an upper portion of said snow gasket has a different stretch property as compared to a lower or intermediate portion of said snow gasket.

76. The snowboard boot binding recited in claim 74, wherein said intermediate portion of said snow gasket has a different abrasion resistance property as compared to each of a top portion and a lower portion of said snow gasket.

77. The snowboard boot binding recited in claim 74, wherein said lower portion of said snow gasket has a different durability property as compared to each of an intermediate portion and an upper portion of said snow gasket.

78. The snowboard boot binding recited in claim 58, wherein said snow gasket includes a lower end and an upper end, and said snow gasket is biased towards said upper end.

79. The snowboard boot binding recited in claim 58, wherein said boot engagement member includes at least one of a strap-type member and a strapless member.

80. A method of assembling a snowboard boot binding, comprising:

providing a binding baseplate including a floor, a medial sidewall, a lateral sidewall, and a heel hoop for surrounding at least a portion of a rider's leg and which extends rearwardly and upwardly from said baseplate floor, wherein an opening extends between the heel hoop and a rearward edge of the baseplate floor that is adapted to receive at least a portion of a heel region of a snowboard boot inserted into the snowboard boot binding; and covering at least a portion of the opening by mounting a snow gasket, separate from a snowboard boot, to the baseplate to prevent snow from passing through the opening and accumulating on the baseplate floor.

81. The method recited in claim 80, wherein said snow gasket includes a frame.

82. The method recited in claim 80, wherein said snow gasket has a variable shape.

83. The method recited in claim 80, wherein said snow gasket is compliant and will assume the general shape of a heel end of said snowboard boot upon insertion of said snowboard boot into said snowboard boot binding.

84. The method recited in claim 80, wherein said snow gasket is removably mounted to said base.

85. The method recited in claim 80, wherein said snow gasket includes a material selected from the group of natural fabrics, plastic fabrics, elastomeric fabrics, and combinations of any of the foregoing.

86. The method recited in claim 85, wherein said snow gasket includes a mesh-type fabric.

87. The method recited in claim 80, wherein said snow gasket extends from at least one of said medial baseplate sidewall, said lateral baseplate sidewall and said baseplate floor.

88. The method recited in claim 87, wherein said snow gasket extends from two of said medial baseplate sidewall, said lateral baseplate sidewall and said baseplate floor.

89. The method recited in claim 87, wherein said snow gasket extends from said medial sidewall, said lateral sidewall, and said base floor.

90. The method recited in claim 80, wherein said snow gasket includes a predetermined region having a property different from another region of said snow gasket, said property including at least one of durability, abrasion resistance, and stretch.

91. The method recited in claim 90, wherein an upper portion of said snow gasket has a different stretch property as compared to a lower or intermediate portion of said snow gasket.

92. The method recited in claim 90, wherein said intermediate portion of said snow gasket has a different abrasion resistance property properties as compared to each of a top portion and a lower portion of said snow gasket.

93. The method recited in claim 90, wherein said lower portion of said snow gasket has a different durability property as compared to each of an intermediate portion and an upper portion of said snow gasket.

94. The method recited in claim 80, wherein said snow gasket includes a lower end and an upper end, and said snow gasket is biased towards said upper end.

* * * * *